US009256163B2

(12) United States Patent
Izumi et al.

(10) Patent No.: US 9,256,163 B2
(45) Date of Patent: Feb. 9, 2016

(54) IMAGE FORMING APPARATUS

(71) Applicant: KYOCERA Document Solutions Inc., Osaka (JP)

(72) Inventors: Koji Izumi, Osaka (JP); Mitsuhiro Goda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/463,358

(22) Filed: Aug. 19, 2014

(65) Prior Publication Data

US 2015/0055978 A1 Feb. 26, 2015

(30) Foreign Application Priority Data

Aug. 22, 2013 (JP) ..... 2013-171995

(51) Int. Cl.

| | |
|---|---|
| ***G03G 15/04*** | (2006.01) |
| ***G03G 15/09*** | (2006.01) |
| ***G03G 15/08*** | (2006.01) |
| ***G03G 21/16*** | (2006.01) |

(52) U.S. Cl.

CPC ..... *G03G 15/0921* (2013.01); *G03G 15/0813* (2013.01); *G03G 21/1647* (2013.01); *G03G 21/1676* (2013.01)

(58) Field of Classification Search

CPC ..... G03G 15/0865; G03G 21/1676; G03G 15/0886; G03G 21/1647; G03G 21/1623; G03G 21/12; G03G 21/1633; G03G 21/18; G03G 2221/1684; G03G 15/043; G03G 15/0872; G03G 15/0874; G03G 15/0875

See application file for complete search history.

(56) References Cited

U.S. PATENT DOCUMENTS

| | | | | |
|---|---|---|---|---|
| 2007/0077087 | A1 | 4/2007 | Okabe et al. | |
| 2009/0041498 | A1 | 2/2009 | Numagami et al. | |
| 2010/0104326 | A1 | 4/2010 | Tanaka | |
| 2011/0182615 | A1 * | 7/2011 | Morishita | 399/111 |
| 2013/0022369 | A1 | 1/2013 | Nishimura | |

FOREIGN PATENT DOCUMENTS

| | | | |
|---|---|---|---|
| EP | 2 148 246 | A2 | 1/2010 |
| JP | 2012-237849 | A | 12/2012 |
| JP | 2013-125149 | A | 6/2013 |

OTHER PUBLICATIONS

The extended European search report issued by European Patent Office on Oct. 24, 2014 in the corresponding European patent application No. 14181406.1—7 pages.

* cited by examiner

*Primary Examiner* — Roy Y Yi

(74) *Attorney, Agent, or Firm* — Knobbe, Martens Olson & Bear LLP

(57) ABSTRACT

A developing unit in an image forming apparatus includes a bearing unit, a first biasing device, a shaft member, and a second biasing device. The bearing unit rotatably supports the respective end portions of the developing roller and the magnetic roller. The first biasing device biases the bearing unit in a direction to cause the developing roller to move toward the image carrier. The shaft member causes the bearing unit to swing by moving in a front-back direction. The second biasing device biases the shaft member in a forward direction. A cover unit of the image forming apparatus presses the shaft member backward by pivoting from an open position to a closed position, and draws out the shaft member in the forward direction by pivoting from the closed position to the open position.

8 Claims, 14 Drawing Sheets

IMAGE FORMING APPARATUS

INCORPORATION BY REFERENCE

This application claims priority to Japanese Patent Application No. 2013-171995 filed on Aug. 22, 2013, the entire contents of which are incorporated by reference herein.

BACKGROUND

The present disclosure relates to an image forming apparatus and a developing unit.

An image forming apparatus based on electrophotography includes a photoconductor drum on which a toner image is formed, and a developing unit for supplying the toner to the photoconductor drum. The developing unit includes a developing roller disposed close to and parallel to the photoconductor drum.

The developing unit is removably installed in the main body of the image forming apparatus. However, since the developing roller is located close to the photoconductor drum as stated above, the developing roller may contact the photoconductor drum in a mounting or removing process of the developing unit.

Accordingly, some image forming apparatuses are configured to move the developing roller away from the photoconductor drum before the developing unit is removed from the main body (technique A).

According to the technique A, the developing unit includes a housing, a developing roller and a magnetic roller disposed parallel to each other, and a bearing unit rotatably supporting the respective end portions of the developing roller and the magnetic roller.

The bearing unit is disposed to swing about the axial center of the magnetic roller, together with the developing roller. The bearing unit is biased by a first spring, so that the developing roller is abutted against the photoconductor drum. An arm member is provided in the vicinity of the magnetic roller of the bearing unit.

The housing includes a shaft member movably extending in the axial direction of the magnetic roller. The shaft member is biased by a second spring so that an end portion sticks out from the housing. The shaft member reciprocally moves in contact with the arm member, so as to cause the arm member and the bearing unit to swing about the axial center of the magnetic roller.

The main body includes a holder unit on which the developing unit is mounted, and an openable cover unit located forward of the holder unit.

Upon closing the cover unit with the developing unit mounted on the holder unit, the end portion of the shaft member which has been sticking out is abutted against the rear face of the cover unit and made to retreat against the biasing force of the second spring. At this point, the arm member and the bearing unit are made to swing by the movement of the shaft member, and the developing roller is pressed and abutted against the photoconductor drum by the biasing force of the first spring.

Conversely, upon opening the cover unit the shaft member is allowed to stick out forward by the biasing force of the second spring. Because of such movement of the shaft member, the arm member and the bearing unit are made to swing against the biasing force of the first spring, and therefore the developing roller moves away from the photoconductor drum.

SUMMARY

The disclosure proposes further improvement of the foregoing technique.

In an aspect, the disclosure provides an image forming apparatus including an image carrier, a developing unit, a holder unit, and a cover unit.

The developing unit includes a developing roller extending in a front-back direction and disposed so as to abut against the image carrier, and a magnetic roller disposed parallel to the developing roller.

The holder unit is configured for the developing unit to be introduced therein with a rear end portion of the developing roller directed ahead, and to be drawn out with a front end portion of the developing roller directed ahead, thus to be removed.

The cover unit is configured to pivot between a closed position in which the cover unit overlaps at least a part of the developing unit mounted on the holder unit when viewed from a position forward of the holder unit, and an open position in which the cover unit does not overlap the developing unit in the same view.

The developing unit further includes a bearing unit rotatably supporting the respective end portions of the developing roller and the magnetic roller and disposed to swing about the axial center of the magnetic roller, a first biasing device that biases the bearing unit in a direction to cause the developing roller to move toward the image carrier, a shaft member movably extending in the front-back direction so as to cause the bearing unit to swing about the axial center of the magnetic roller, and a second biasing device that biases the shaft member in a forward direction against the biasing force of the first biasing device.

The cover unit is configured to press the shaft member backward to a rear position to cause the developing roller to abut against the image carrier, by pivoting from the open position to the closed position, and to draw out the shaft member to a forward position to cause the developing roller to move away from the image carrier, by pivoting from the closed position to the open position.

In another aspect, the disclosure provides a developing unit applicable to the image forming apparatus defined above.

DETAILED DESCRIPTION

Hereafter, an embodiment of the disclosure will be described with reference to the drawings. It should be noted that the disclosure is in no way limited to the following embodiment.

Figure 1:
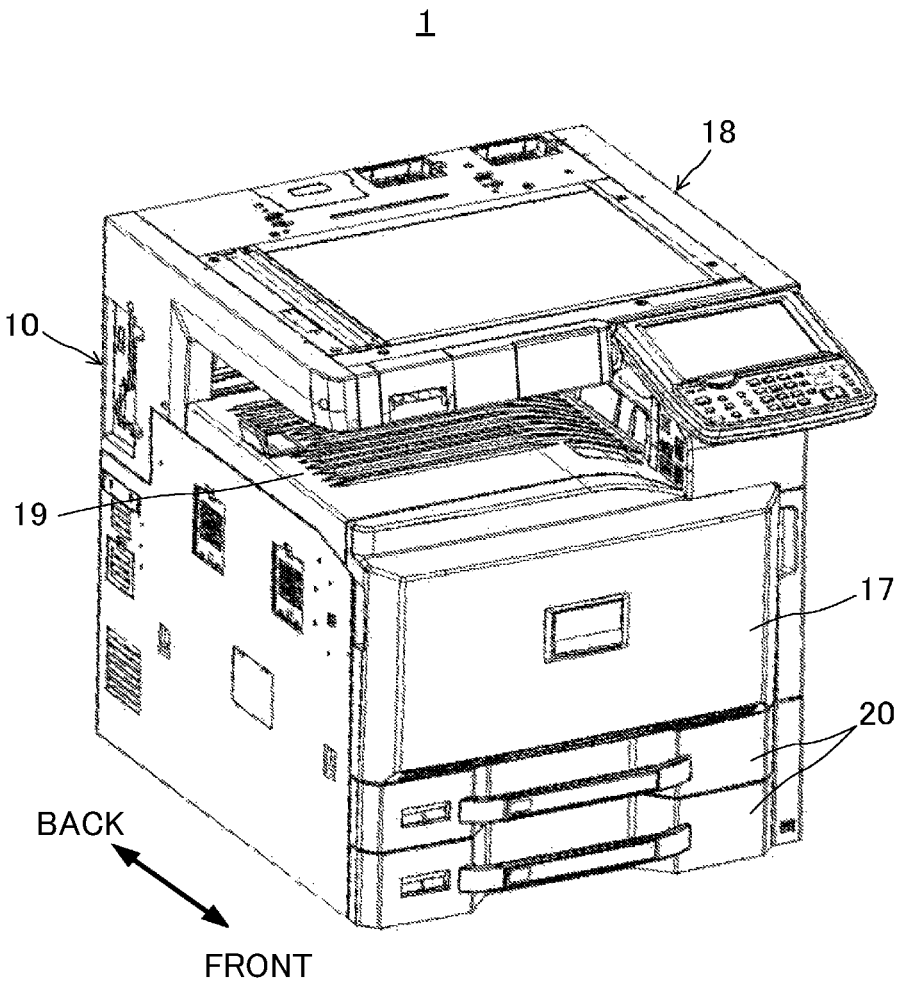
FIG. 1 is a perspective view showing an appearance of an image forming apparatus.
Figure 2:
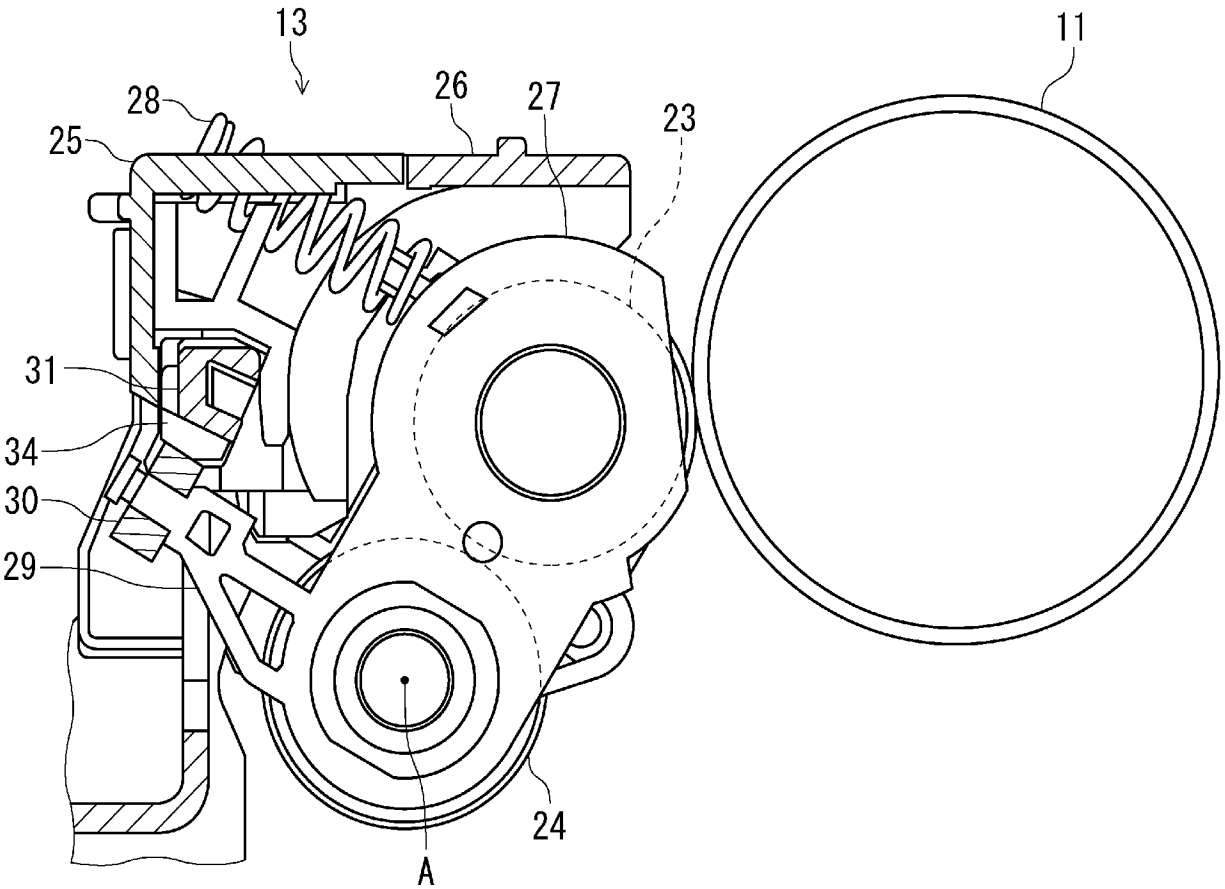
FIG. 2 is a partially cut-away front view showing an essential part of a photoconductor drum and a developing unit.
Figure 3:
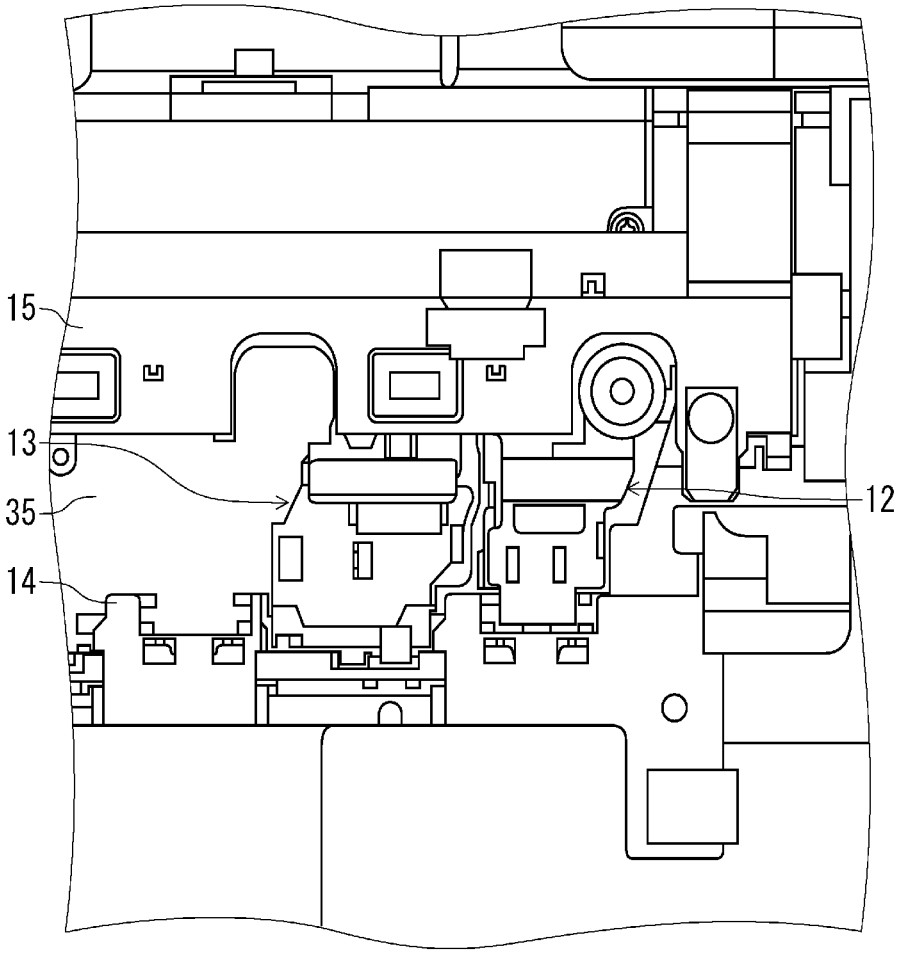
FIG. 3 is a front view showing a holder unit and a cover unit.
Figure 4:
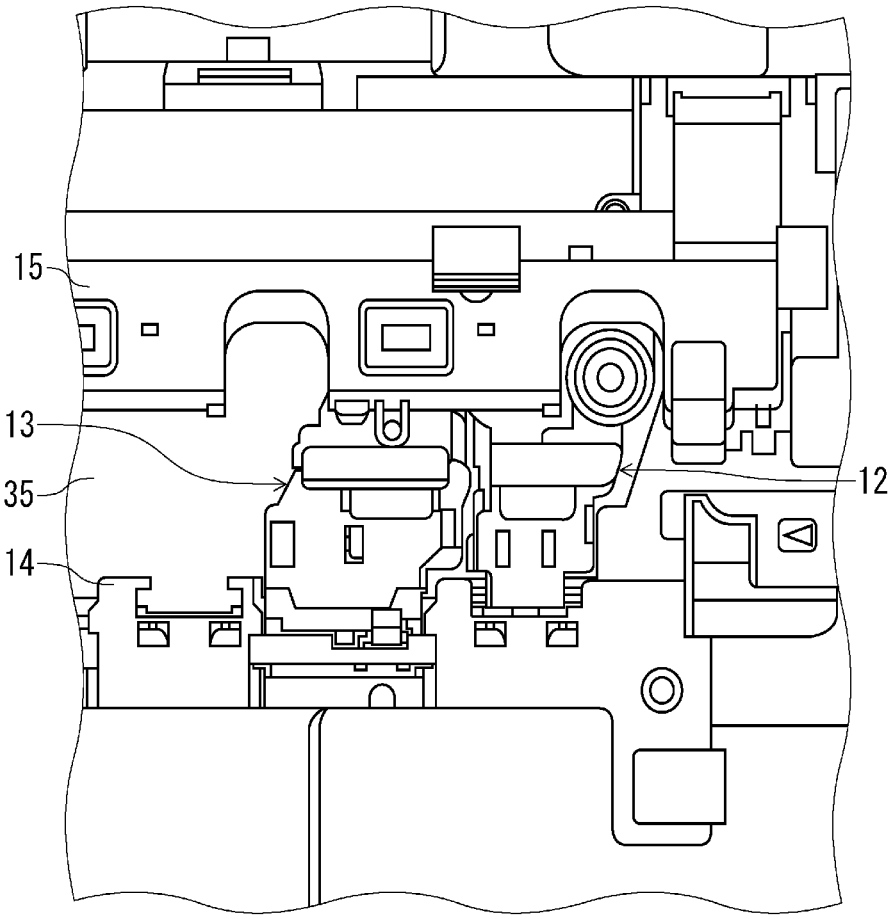
FIG. 4 is another front view showing the holder unit and the cover unit.
Figure 5:
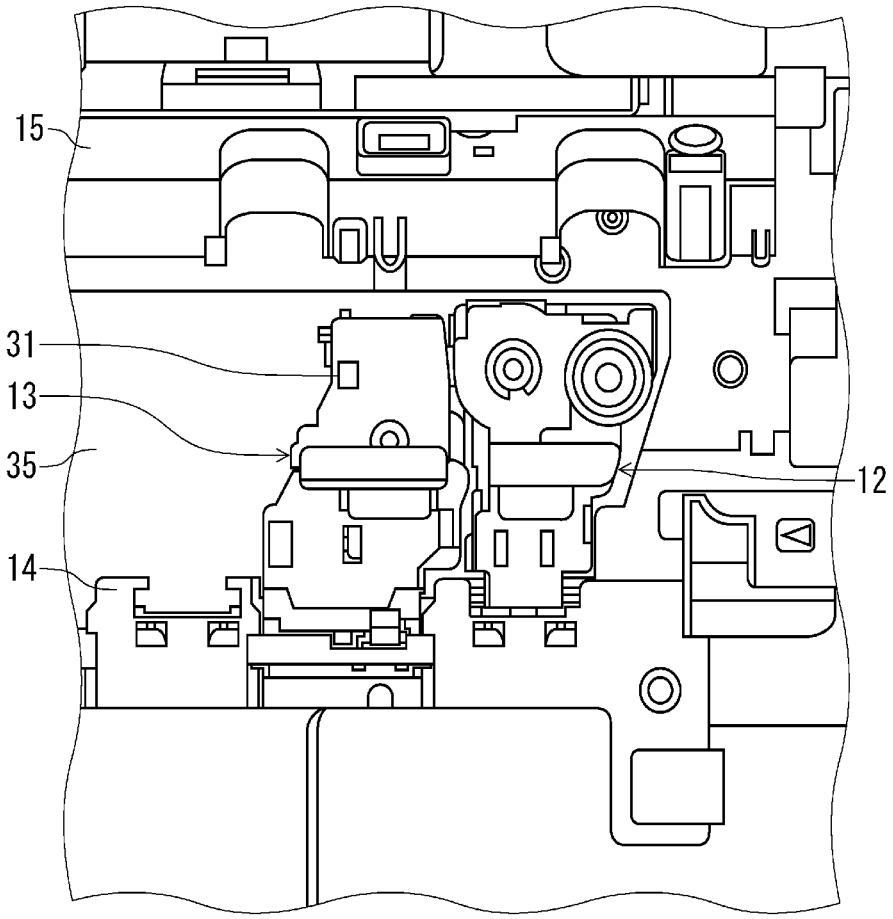
FIG. 5 is still another front view showing the holder unit and the cover unit.

FIG. 1 illustrates an appearance of a multifunction peripheral 1 according to this embodiment, exemplifying the image forming apparatus in the disclosure. FIG. 2 illustrates an essential part of a photoconductor drum 11 as an example of an image carrier and a developing unit 13. FIGS. 3 to 5 illustrate appearances of a holder unit 14 and a cover unit 15. In FIG. 1, a platen (document holder) is not shown.

The multifunction peripheral 1 is an electrophotographic image forming apparatus, and includes a casing 10 constituting the main body of the apparatus as shown in FIG. 1. The casing 10 accommodates therein a drum unit 12 including the photoconductor drum 11, a developing unit 13 that develops a static latent image formed on the photoconductor drum 11, a holder unit 14 on which the photoconductor drum 11 and the developing unit 13 are removably mounted, and the cover unit 15 located forward of the holder unit 14.

As shown in FIG. 1, a front cover 17 is provided on the front face of the casing 10. The holder unit 14 and the cover unit 15 are covered with the front cover 17 thus to be enclosed inside the casing 10.

A scanner unit 18 for scanning documents is provided on top of the casing 10. A paper discharge unit 19 that discharges paper sheets with images formed thereon out of the casing 10 is provided under the scanner unit 18. Paper feed cassettes 20 are provided under the holder unit 14. Although not shown, the casing 10 also accommodates therein an optical scanning unit that emits a laser beam onto the photoconductor drum 11 for scanning and a fixing unit that fixes the toner image formed on the paper sheet, to the same paper sheet.

The multifunction peripheral 1 includes four drum units 12 respectively corresponding to four colors, for example yellow, magenta, cyan, and black. The drum units 12 each include the photoconductor drum 11 and a charger and a cleaning unit (neither shown) located around the photoconductor drum 11.

The charger electrically charges the surface of the photoconductor drum 11. The photoconductor drum 11 charged by the charger is irradiated with the laser beam from the optical scanning unit, so that a static latent image is formed on the photoconductor drum 11. The cleaning unit serves to clean the surface of the photoconductor drum 11.

Figure 6:
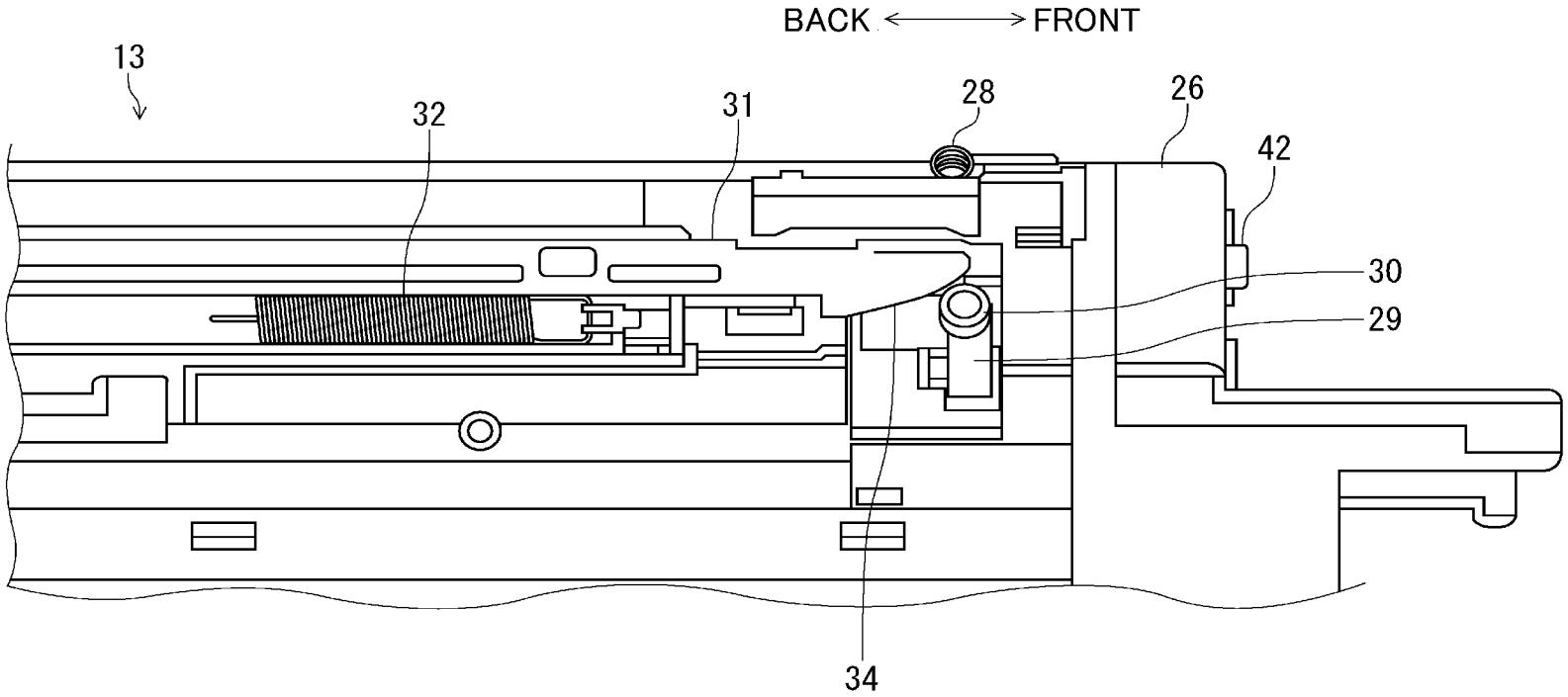
FIG. 6 is an enlarged side view showing an end portion of the developing unit.
Figure 7:
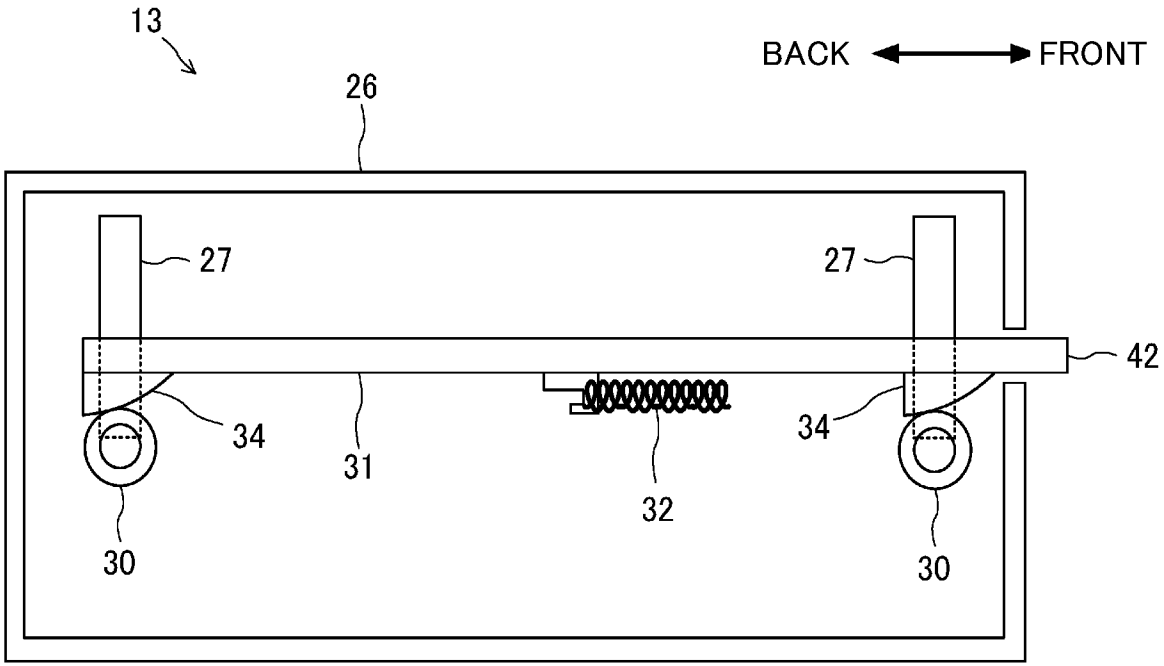
FIG. 7 is a schematic cross-sectional view showing a configuration of a part of the developing unit.

FIG. 6 is an enlarged view of an end portion of the developing unit 13. FIG. 7 schematically illustrates a configuration of a part of the developing unit 13. Hereafter, the right side in FIGS. 6 and 7 will be defined as front side, and the left side in these drawings will be defined as rear side. In FIGS. 2 to 5, the side of the viewer will be defined as front side, and the deeper side will be defined as rear side.

The multifunction peripheral 1 includes four developing units 13 respectively corresponding to the four drum units 12. The developing units 13 are of a hybrid type, and each include a developing roller 23 extending in the front-back direction along the photoconductor drum 11, and a magnetic roller 24 disposed parallel to the developing roller 23. The developing roller 23 is disposed so as to abut against the photoconductor drum 11.

The developing units 13 are configured to apply a two-component developer containing a carrier and a toner to the surface of the magnetic roller 24 to form a magnetic brush, and to form a toner layer on the surface of the developing roller 23 with the toner supplied from the magnetic brush to the developing roller 23. Then the developing units 13 cause the toner to fly from the toner layer to the photoconductor drum 11, to thereby develop the static latent image on the surface of the photoconductor drum 11, as a toner image.

Referring to FIG. 2, the developing units 13 each include a housing 26 to which a side cover 25 is attached, and a bearing unit 27 that rotatably supports the respective end portions of the developing roller 23 and the magnetic roller 24. The bearing unit 27 is provided on each of the end portions of the developing roller 23 and the magnetic roller 24. The bearing units 27 are mounted on the housing 26 so as to swing about the axial center A of the magnetic roller 24. Upon swinging about the axial center A of the magnetic roller 24, the developing roller 23 can be abutted against the photoconductor drum 11.

Further, the developing units 13 each include a first spring 28 that biases the bearing unit 27 in a direction to move the developing roller 23 toward the photoconductor drum 11, the first spring 28 exemplifying the first biasing device in the disclosure, and an arm member 29 fixed to the bearing unit 27.

The first spring 28 is a compression spring, and has an end portion attached to the side cover 25 and the other end portion engaged with the bearing unit 27 at a position close to the developing roller 23. In this embodiment, the arm member 29 is formed integrally with the bearing unit 27 so as to extend from a position close to the magnetic roller 24. A bearing 30 is provided on the distal end portion of the arm member 29. The arm member 29 is subjected to the biasing force of the first spring 28 in a direction to move the bearing 30 of the arm member 29 upward in FIGS. 2 and 6 (first direction).

As shown in FIGS. 6 and 7, the developing units 13 each include a shaft member 31 movably extending in the front-back direction, and a second spring 32 that biases the shaft member 31 in the forward direction, the second spring 32 exemplifying the second biasing device in the disclosure.

The shaft member 31 is supported by the housing 26 and covered with the side cover 25. Here, FIG. 6 illustrates the state in which the side cover 25 is removed so as to expose the shaft member 31. In addition, the cover unit 15 is excluded in FIG. 6.

The shaft member 31 includes a cam portion 34 disposed in contact with the bearing 30 so as to guide the arm member 29 when the shaft member 31 moves in the front-back direction. When the shaft member 31 moves in the forward direction, the cam portion 34 presses the bearing 30 downward in FIGS. 2 and 6 (second direction), which is opposite to the first direction, to thereby cause the arm member 29 and the bearing unit 27 to swing about the axial center A of the magnetic roller 24 so that the developing roller 23 is separated from the photoconductor drum 11.

When the shaft member 31 moves backward, on the contrary, the cam portion 34 guides the bearing 30 in the first direction (upward in FIGS. 2 and 6), to thereby cause the arm member 29 and the bearing unit 27 to swing about the axial center A of the magnetic roller 24 so that the developing roller 23 is abutted against the photoconductor drum 11.

The second spring 32 is a tension spring, and has an end portion fixed to the housing 26 and the other end portion engaged with the shaft member 31, so as to bias the shaft member 31 in the forward direction.

In contrast, the biasing force of the first spring 28 is exerted on the bearing unit 27 in the direction to move the bearing 30 upward in FIGS. 2 and 6. Accordingly, the first spring 28 biases the shaft member 31 backward, via the cam portion 34 disposed in contact with the bearing 30. Conversely, the second spring 32 biases the shaft member 31 in the forward direction against the biasing force of the first spring 28.

Referring to FIGS. 3 to 5, the holder unit 14 includes a mounting cavity 35 in which the developing units 13 and the drum units 12 are mounted. The mounting cavity 35 extends in the front-back direction and is open at the front end portion. The developing units 13 are each introduced into the mounting cavity 35 of the holder unit 14, with the rear end portion of the developing roller 23 directed ahead. Likewise, the drum units 12 are each introduced into the mounting cavity 35 of the holder unit 14, with the rear end portion of the photoconductor drum 11 directed ahead. Thus, the developing units 13 and the drum units 12 are alternately aligned in the holder unit 14.

In contrast, the developing units 13 are drawn out with the front end portion of the developing roller 23 directed ahead, to be removed from the holder unit 14. Likewise, the drum units 12 are drawn out with the front end portion of the photoconductor drum 11 directed ahead, to be removed from the holder unit 14.

Figure 8:
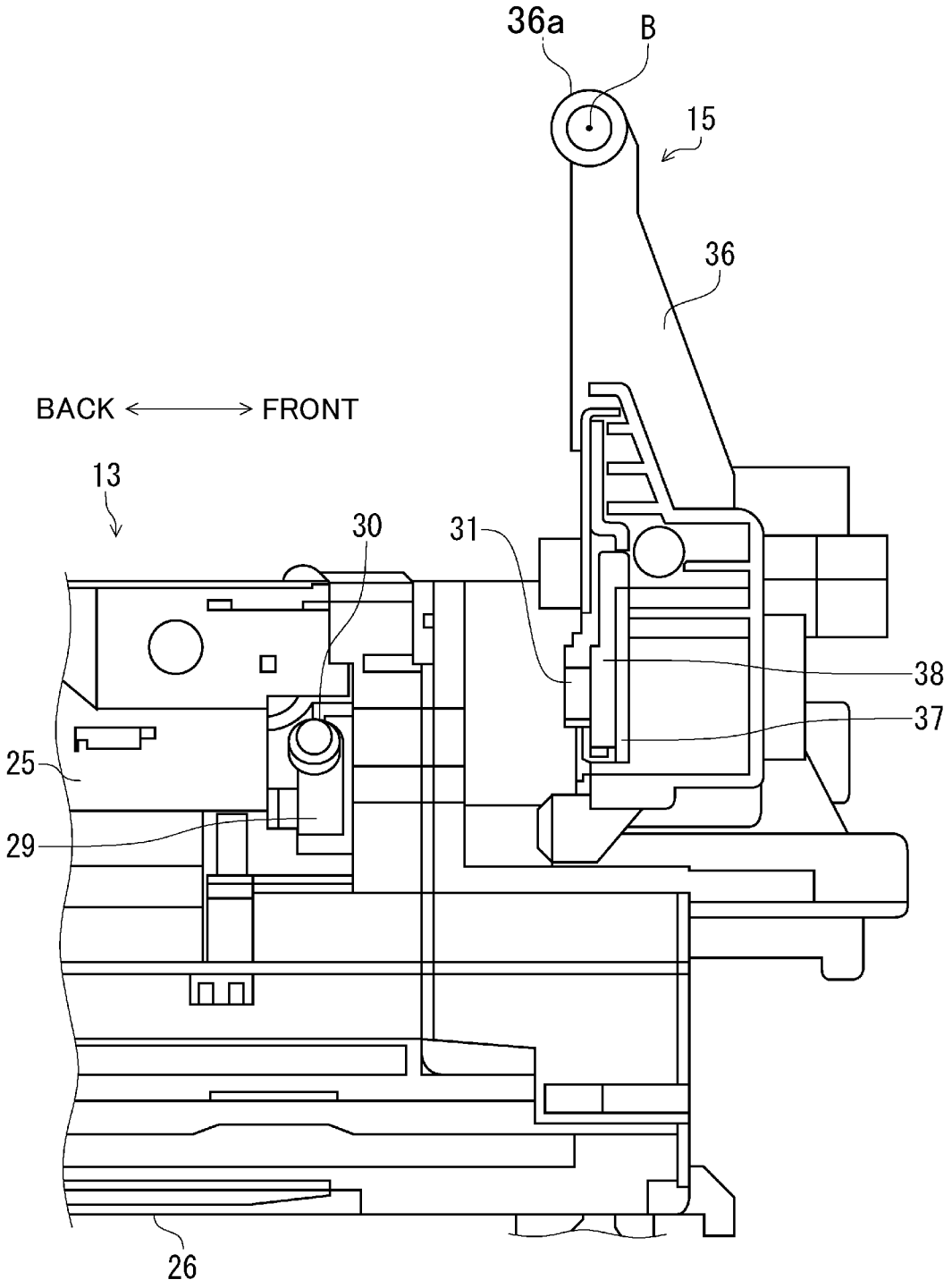
FIG. 8 is a side view showing the developing unit and the cover unit.
Figure 9:
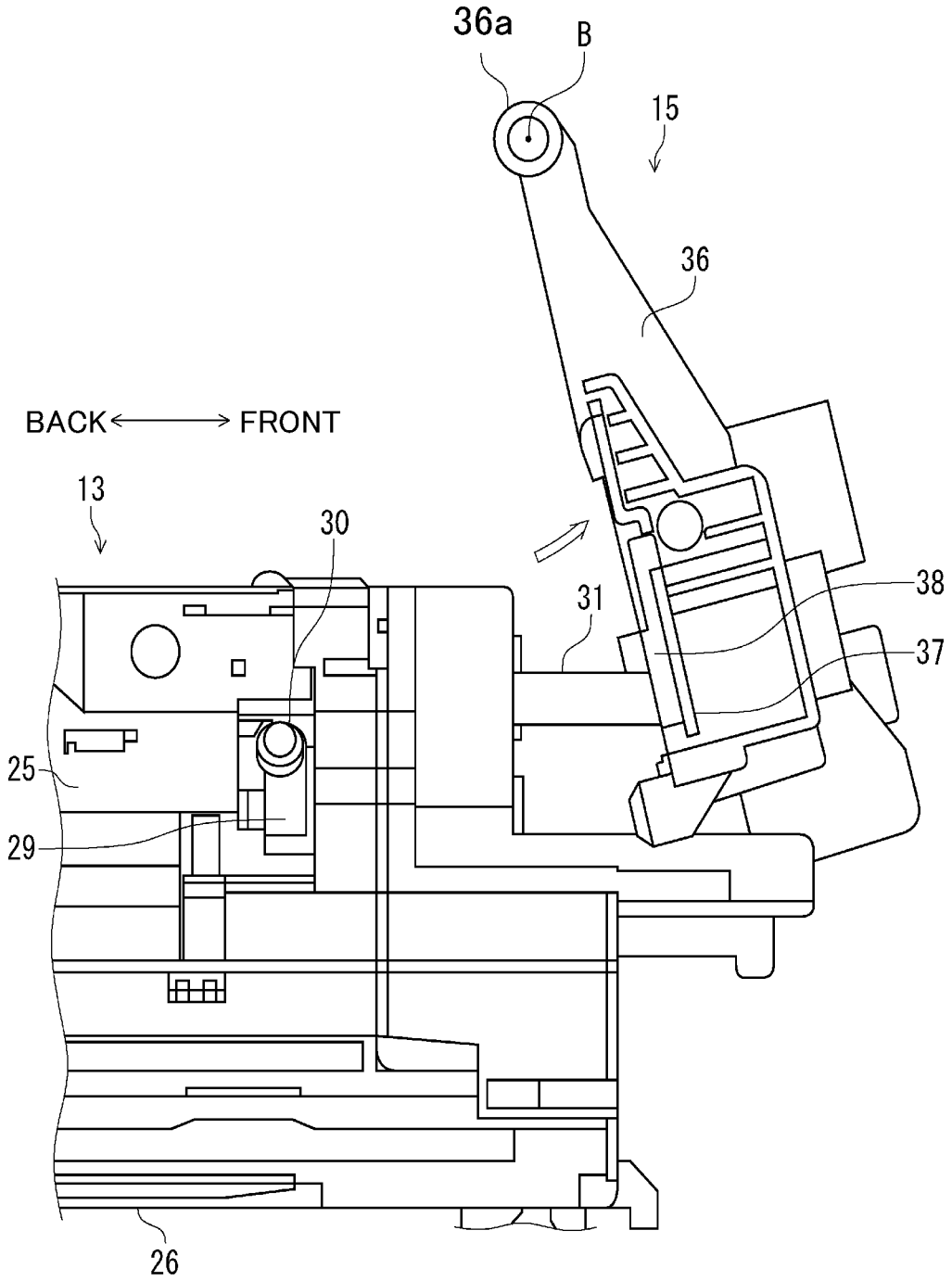
FIG. 9 is another side view showing the developing unit and the cover unit.
Figure 10:
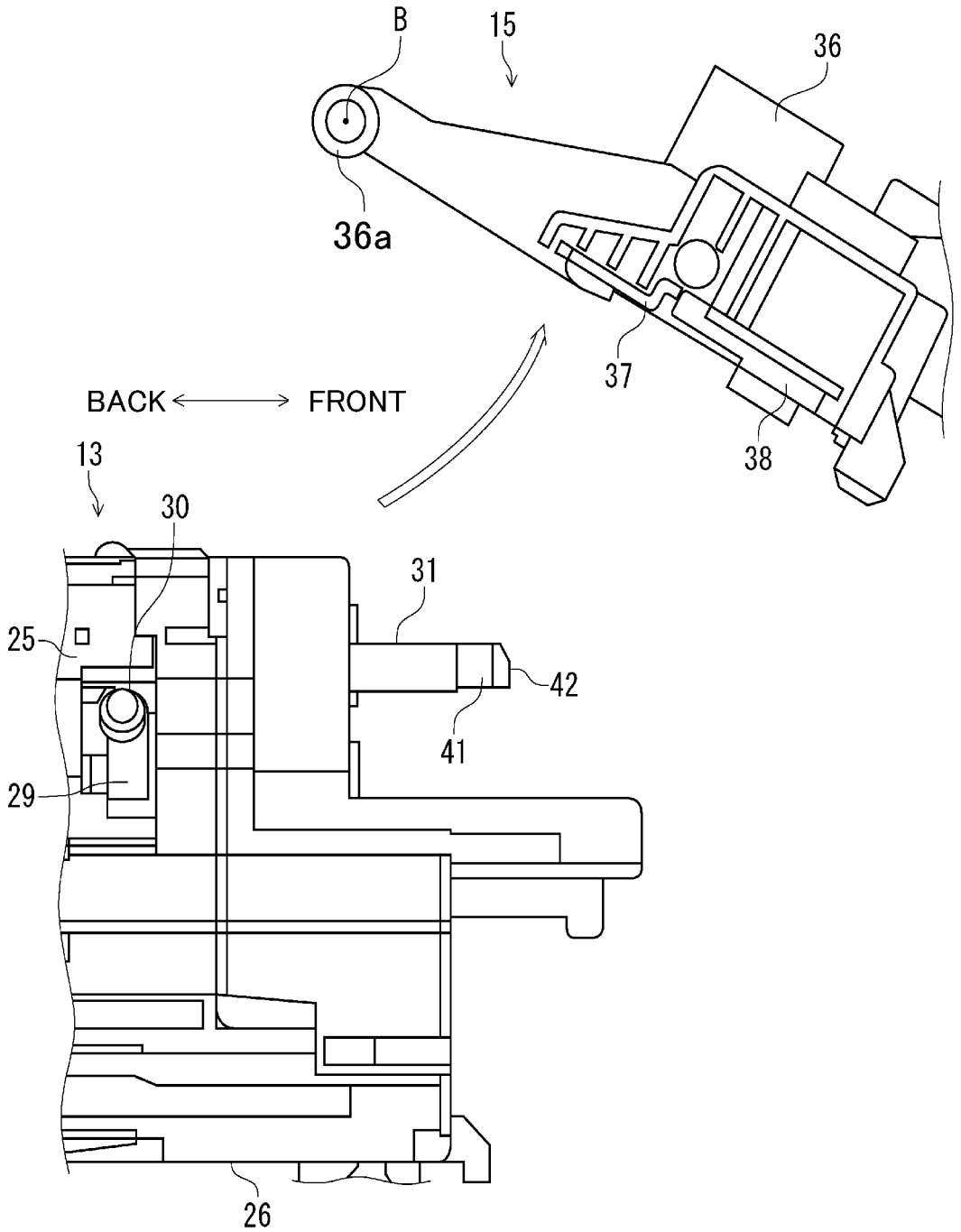
FIG. 10 is still another side view showing the developing unit and the cover unit.

FIGS. 8 to 10 illustrate the developing unit 13 and the cover unit 15. In FIGS. 8 to 10, the holder unit 14 is excluded.

As shown in FIGS. 3 to 5 and FIGS. 8 to 10, the cover unit 15 is pivotably supported by the holder unit 14. The cover unit 15 is set to pivot between a closed position (see FIGS. 3 and 8) in which the cover unit 15 overlaps at least a part of the developing units 13 mounted on the holder unit 14, when viewed from a position forward of the holder unit 14 and an open position (see FIGS. 5 and 10) in which the cover unit 15 does not overlap the developing units 13.

The cover unit 15 sets the drum units 12 to a predetermined position and presses the shaft member 31 of the developing unit 13 backward to the rear position, by pivoting from the open position to the closed position. Conversely, the cover unit 15 draws out the shaft member 31 of the developing unit 13 to the forward position, by pivoting from the closed position to the open position.

Thus, the shaft member 31 is movable between the rear position and the forward position. When the shaft member 31 is pressed to the rear position, the developing roller 23 is abutted against the photoconductor drum 11. In contrast, when the shaft member 31 is set to the forward position the developing roller 23 is separated from the photoconductor drum 11.

The cover unit 15 includes a cover main body 36, a support plate 37 attached to the cover main body 36, and an engaging device 38 fixed to the support plate 37. The cover main body 36 includes a pivotal shaft 36*a* supported by the holder unit 14. The engaging device 38 is configured so as to be engaged with the leading end portion of the shaft member 31.

Figure 11:
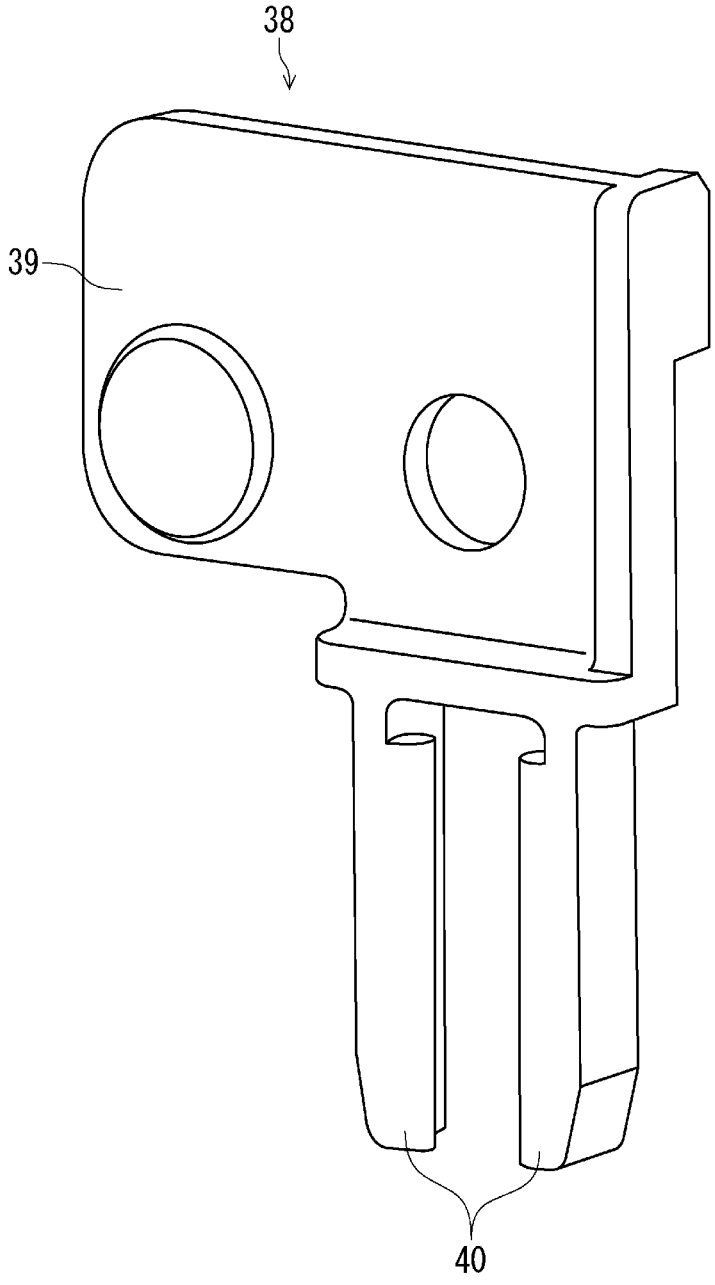
FIG. 11 is an enlarged perspective view showing an engaging device.
Figure 12:
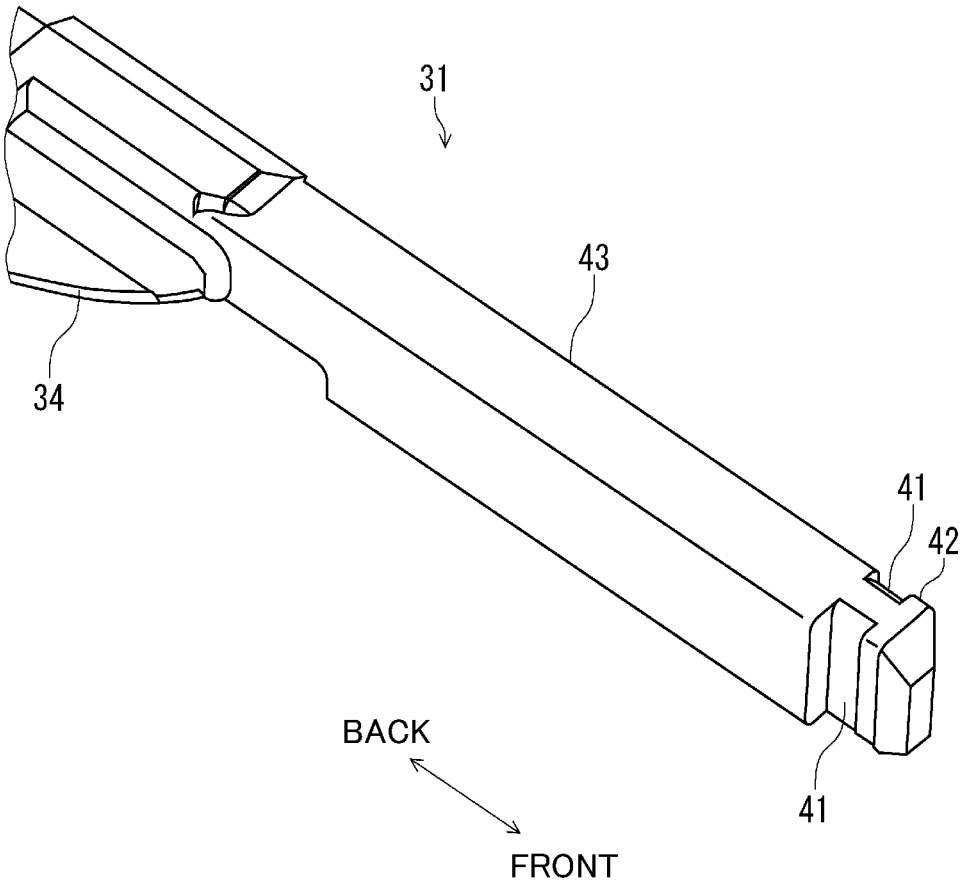
FIG. 12 is an enlarged perspective view showing a leading end portion of a shaft member.
Figure 13:
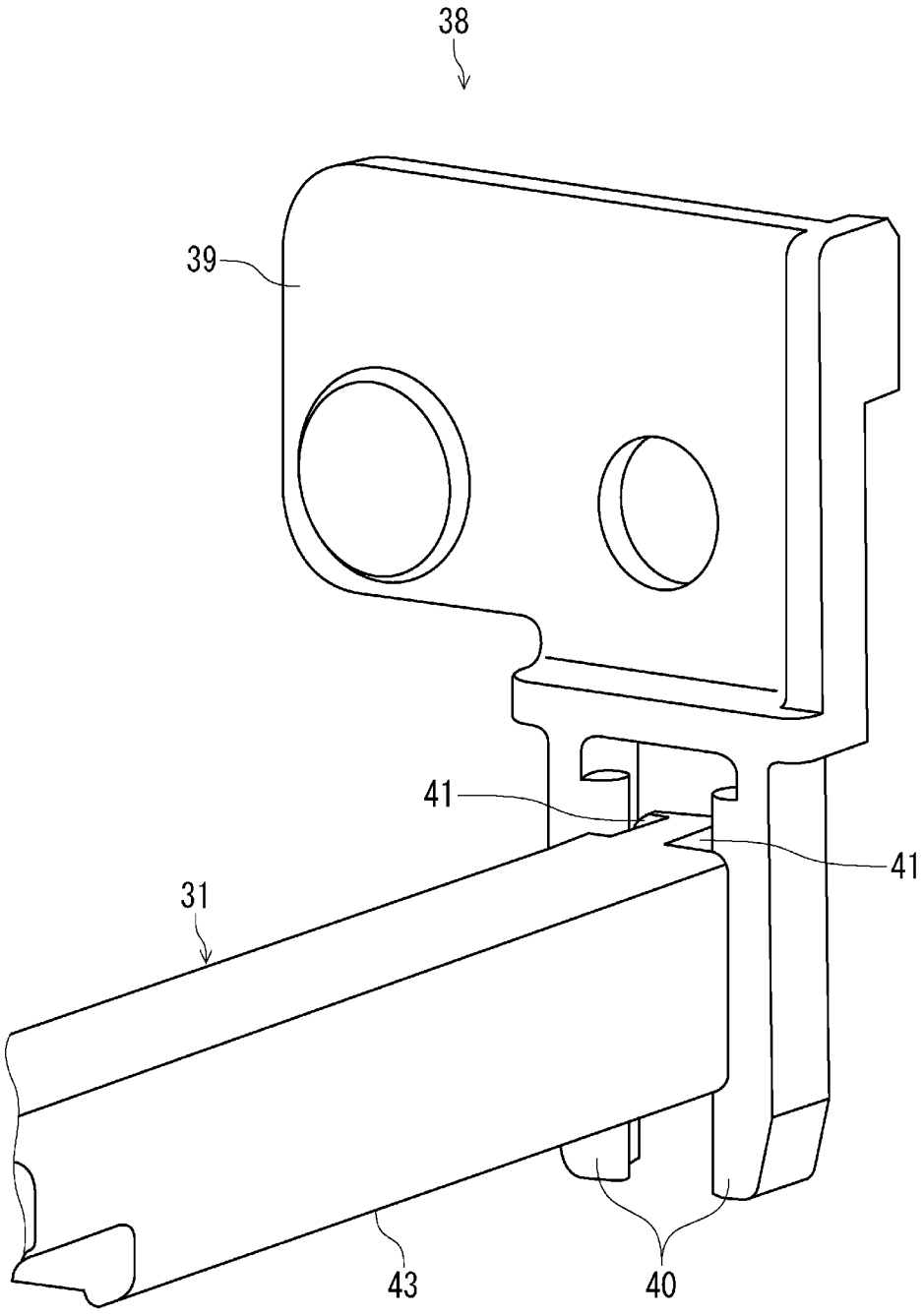
FIG. 13 is a perspective view showing the engaging device engaged with the shaft member.
Figure 14:
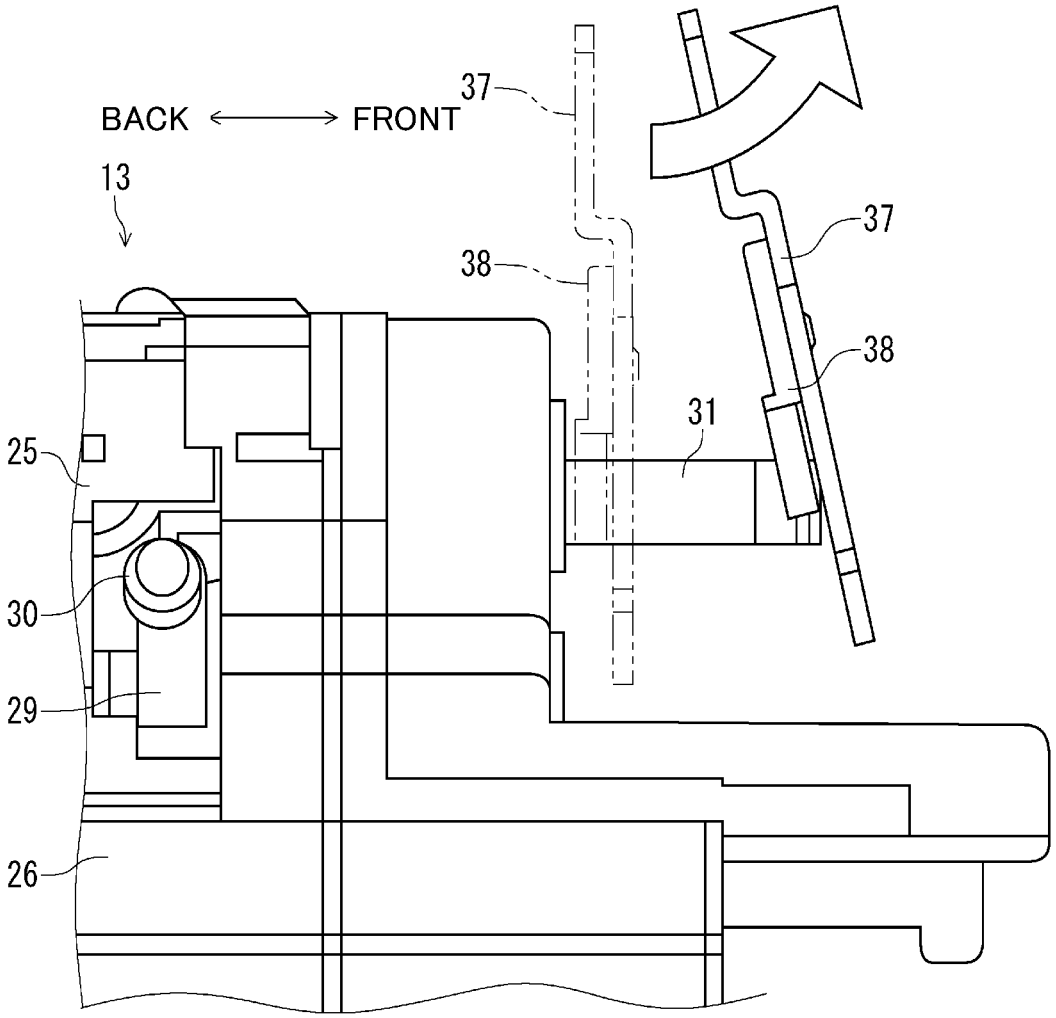
FIG. 14 is a side view showing the shaft member being drawn out by the engaging device.

FIG. 11 illustrates the engaging device 38 in an enlarged scale. FIG. 12 illustrates the leading end portion of the shaft member 31 in an enlarged scale. FIG. 13 illustrates the engaging device 38 engaged with the shaft member 31. FIG. 14 illustrates the shaft member 31 being drawn out by the engaging device 38. In FIG. 14, the cover main body 36 is excluded.

As shown in FIGS. 11 to 13, the engaging device 38 is constituted of a hook member configured to hold the leading end portion of the shaft member 31 from both sides. To be more detailed, the engaging device 38 includes a bracket portion 39 attached to the support plate 37 and a fork-shaped nail 40 formed integrally with the bracket portion 39. The nail 40 extends perpendicular to an axial center B of the pivotal shaft 36*a* of the cover main body 36 (the pivotal shaft of the cover 15). On the leading end portion of the shaft member 31, a pair of grooves 41 is formed to be held between both sides of the nail 40.

The shaft member 31 includes a leading end portion 42 on the front side of the grooves 41 and a base portion 43 on the rear side of the grooves 41. The width of the leading end portion 42 in the direction of being held between both sides of the nail 40 (hereinafter simply referred to as width) is narrower than that of the base portion 43. In addition, the leading end portion 42 is tapered such that the width gradually decreases in the forward direction. Such a configuration facilitates the nail 40 of the engaging device 38 to be engaged with the grooves 41 of the shaft member 31.

As shown in FIGS. 8 to 10 and FIG. 14, the cover unit 15 draws out the shaft member 31 caught by the engaging device 38 in the forward position, upon pivoting about the axial center B of the pivotal shaft 36*a* from the closed position (see FIG. 8) to the open position (see FIG. 10).

With the configuration described above, to mount the developing unit 13 in the multifunction peripheral 1 the developing unit 13 is introduced in the holder unit 14 with the rear end portion of the developing roller 23 directed ahead, for example as shown in FIG. 5. At this point, the second spring 32 biases the shaft member 31 in the forward direction against the biasing force of the first spring 28. Accordingly, the shaft member 31 is located at the forward position for example as shown in FIGS. 10 and 14.

Then the cover unit 15 is made to pivot downward from the open position to the closed position, as shown in FIGS. 3 to 5 and FIGS. 8 to 10. With this pivoting motion, the cover unit 15 presses backward the shaft member 31 abutted against the support plate 37 of the cover unit 15, against the biasing force of the second spring 32. Accordingly, the shaft member 31 is moved from the forward position to the rear position. At this point, the nail 40 of the engaging device 38 of the cover unit 15 is engaged with the grooves 41 at the leading end portion of the shaft member 31.

Owing to the backward movement of the shaft member 31, the arm member 29 is guided by the cam portion 34 so that the arm member 29 and the bearing unit 27 are made to swing about the axial center A of the magnetic roller 24. Therefore, the developing roller 23, subjected to the biasing force of the first spring 28 via the bearing unit 27, is made swing toward the photoconductor drum 11. Then when the shaft member 31 reaches the rear position (for example, see FIG. 6), the developing roller 23 is abutted against the photoconductor drum 11.

Conversely, to remove the developing unit 13 from the multifunction peripheral 1, first the cover unit 15 is made to pivot from the closed position to the open position. Since the shaft member 31 is engaged with the engaging device 38 of the cover unit 15 at the initial stage of the pivotal motion of the cover unit 15 from the closed position, the shaft member 31 is drawn out in the forward direction by the cover unit 15, under the biasing force of the second spring 32.

With the forward movement of the shaft member 31, the arm member 29 is guided by the cam portion 34 so that the arm member 29 and the bearing unit 27 are made to swing about the axial center A of the magnetic roller 24. Therefore, the developing roller 23 moves away from the photoconductor drum 11 against the biasing force of the first spring 28, thus to be separated from the photoconductor drum 11.

The shaft member 31 is unable to move further forward upon reaching the forward position. Accordingly, as shown in FIGS. 9, 10, and 14, when the cover unit 15 is made to pivot further toward the open position after the shaft member 31 has reached the forward position, the nail 40 of the engaging device 38 is disengaged from the grooves 41 of the shaft member 31.

With the configuration according to this embodiment, therefore, the developing unit 13 can be removed from the multifunction peripheral 1 with the developing roller 23 located away from the photoconductor drum 11.

Now, regarding the configuration according to the technique A, it is preferable to increase the biasing force of the first spring in order to assure that the developing roller is abutted against the photoconductor drum.

However, it is necessary to make the biasing force of the second spring larger than that of the first spring, in order to allow the shaft member to be moved forward by the biasing force of the second spring when the cover is opened. Accordingly, increasing the biasing force of the first spring makes it necessary to make the biasing force of the second spring even larger.

Increasing the biasing force of the second spring incurs a disadvantage in that the cover becomes difficult to close, because a greater force is necessary to close the cover against the biasing force of the second spring.

According to this embodiment, in contrast, the shaft member 31 is forcibly drawn out by the cover unit 15, which eliminates the need to make the biasing force of the second spring 32 larger than that of the first spring 28, despite the biasing force of the first spring 28 being increased to assure that the developing roller 23 is abutted against the photoconductor drum 11. Therefore the biasing force of the second spring 32 can be made relatively smaller, which facilitates the cover unit 15 to be closed against the biasing force of the second spring 32. Thus, the configuration according to this embodiment facilitates the cover unit 15 to be closed with a smaller force, despite the developing roller 23 being assured to be abutted against the photoconductor drum 11.

According to this embodiment, the cover unit 15 includes the engaging device 38 to be engaged with the leading end portion of the shaft member 31, and is configured to draw out the shaft member 31 caught by the engaging device 38 to the forward position, by pivoting from the closed position to the open position.

The mentioned configuration allows, when the developing unit 13 is to be removed from the multifunction peripheral 1, the shaft member 31 caught by the engaging device 38 of the cover unit 15 to be securely led to the forward position in linkage with the pivoting motion of the cover unit 15, when the cover unit 15 is made to pivot from the closed position to the open position.

In addition, the engaging device 38 includes the hook member configured to hold the leading end portion of the shaft member 31 from both sides in this embodiment. Therefore, the engaging device 38 can be properly engaged with the shaft member 31 with a simple structure.

In this embodiment, further, the shaft member 31 includes the cam portion 34 to be abutted against the end portion of the arm member 29 fixed to the bearing unit 27, so as to guide the movement of the arm member 29. The cam portion 34 moves the arm member 29 in the second direction opposite to the first direction in which the arm member 29 is moved by the biasing force of the first spring 28, when the shaft member 31 is drawn out to the forward position. On the contrary, when the shaft member 31 is pressed backward to the rear position, the cam portion 34 moves the arm member 29 in the first direction.

The mentioned configuration allows the bearing unit 27 and the arm member 29 to swing in linkage with the movement of the shaft member 31 in the front-back direction.

Although the hook-shaped engaging device 38 is engaged with the shaft member 31 in this embodiment, a different configuration may be adopted to draw out the shaft member 31 with the cover unit 15. For example, the leading end portion of the shaft member 31 may be formed in a hook shape, so that the hook-shaped leading end portion is engaged with the cover unit 15.

Although the multifunctional peripheral is taken up as an example of the image forming apparatus according to the disclosure in the foregoing embodiment, the disclosure is broadly applicable to different image forming apparatuses such as a printer, a scanner, and a copier.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

an image carrier;

a developing unit including a developing roller extending in a front-back direction and disposed so as to abut against the image carrier, and a magnetic roller disposed parallel to the developing roller;

a holder unit in which the developing unit is introduced with a rear end portion of the developing roller directed ahead, and from which the developing unit is drawn out with a front end portion of the developing roller directed ahead thus to be removed; and a cover unit configured to pivot between a closed position in which the cover unit overlaps at least a part of the developing unit mounted on the holder unit when viewed from a position forward of the holder unit, and an open position in which the cover unit does not overlap the developing unit in the same view, wherein the developing unit further includes:

a bearing unit rotatably supporting the respective end portions of the developing roller and the magnetic roller and disposed to swing about the axial center of the magnetic roller;

a first biasing device that biases the bearing unit in a direction to cause the developing roller to move toward the image carrier;

a shaft member movably extending in the front-back direction so as to cause the bearing unit to swing about the axial center of the magnetic roller; and a second biasing device that biases the shaft member in a forward direction against the biasing force of the first biasing device, and the cover unit is configured to transmit, by pivoting from the closed position to the open position, moving force of the cover unit toward the open position to the shaft member, to thereby draw out the shaft member to a forward position to cause the developing roller to move away from the image carrier, and to press the shaft member backward to a rear position to cause the developing roller to abut against the image carrier, by pivoting from the open position to the closed position.

2. The image forming apparatus according to claim 1, wherein the cover unit includes an engaging device to be engaged with a leading end portion of the shaft member, and is configured to transmit, by pivoting from the closed position to the open position, the moving force of the cover unit toward the open position to the shaft member engaged with the engaging device, to thereby draw out the shaft member to a forward position.

3. The image forming apparatus according to claim 2, wherein the engaging device includes a bracket portion attached to the support plate attached to a cover main body of the cover unit, and fork-shaped nail formed integrally with bracket portion.

4. The image forming apparatus according to claim 3, wherein the nail extends perpendicular to an axial center of a pivotal shaft of the cover unit, a groove is formed to be held between both sides of the nail on a leading end portion of the shaft member.

5. The image forming apparatus according to claim 4, wherein the shaft member includes a leading end portion on a front side of the groove, and a base portion on a rear side of the groove, a width of the leading end portion in a direction of being held between both sides of the nail is narrower than the base portion.

6. The image forming apparatus according to claim 5, wherein the width of the leading end portion gradually decreases in the forward direction.

7. The image forming apparatus according to claim 2, wherein the engaging device includes a hook member that holds the leading end portion of the shaft member from both sides.

8. The image forming apparatus according to claim 1, wherein the developing unit further includes an arm member fixed to the bearing unit, the shaft member includes a cam portion to be abutted to an end portion of the arm member so as to guide a movement of the arm member, the cam portion moves the arm member in a second direction opposite to a first direction in which the arm member is moved by a biasing force of the first biasing device, when the shaft member is drawn out to the forward position, and moves the arm member in the first direction when the shaft member is pressed backward to the rear position.

* * * * *